United States Patent [19]

Kelly

[11] Patent Number: 4,817,819

[45] Date of Patent: Apr. 4, 1989

[54] CONTAINER FOR TABLETS

[75] Inventor: Thomas K. Kelly, Larchmont, N.Y.

[73] Assignee: Berlex Laboratories, Inc., Cedar Knolls, N.J.

[21] Appl. No.: 16,474

[22] Filed: Feb. 17, 1987

Related U.S. Application Data

[63] Continuation of Ser. No. 810,620, Dec. 19, 1985, abandoned.

[51] Int. Cl.[4] ..... B65D 83/04

[52] U.S. Cl. ..... 221/2; 221/25; 221/89; 206/531; 206/534; 206/539; 116/308

[58] Field of Search ..... 221/2, 4–5, 221/25, 76, 86, 89, 69, 64, 82; 206/531–534, 538–539; 220/345, 346, 350–351; 116/308

[56] References Cited

U.S. PATENT DOCUMENTS

| | | | |
|---|---|---|---|
| 2,708,026 | 5/1955 | Duell | 206/539 |
| 3,324,996 | 6/1967 | Jordt | 206/539 X |
| 3,504,788 | 4/1970 | Gray | 206/539 X |
| 3,527,190 | 9/1970 | Huck | 116/308 |
| 3,587,517 | 6/1971 | Fites et al. | 116/308 |
| 3,833,143 | 9/1974 | Starkermann et al. | 206/538 X |
| 4,406,362 | 9/1983 | Thomas et al. | 220/346 X |

*Primary Examiner*—Charles A. Marmor

*Attorney, Agent, or Firm*—Elizabeth A. Bellamy; John R. Moses; I. William Millen

[57] ABSTRACT

A tablet container having a cover and sliding tray is used for dispensing birth control tablets for either a twenty-one-day or twenty-eight-day cycle. Normally, the tray does not slide completely out of the cover and is stabilized with respect thereto when open. The case resembles a cosmetic compact and is reuseable in that once birth control tablets contained in a blister pack are used up, a new blister pack may easily be inserted.

4 Claims, 3 Drawing Sheets

CONTAINER FOR TABLETS

This application is a continuation of application Ser. No. 810,620, filed Dec. 19, 1985, now abandoned.

BACKGROUND OF THE INVENTION

1. Field of the Invention

The instant invention relates to container for tablets, and more particularly, the instant invention relates to containers for retaining and concealing tablets arrayed in blister packs and used for purposes such as birth control.

2. Technical Considerations and Prior Art

The utilization of birth control tablets generally requires that the tablets be taken one at a time in a preselected order on an daily basis. The tablets are dispensed in accordance with either a 21-day cycle or a 28-day cycle regime. It has been found that utilizing blister packs arranged in seven columns, one for each day, and either three rows or four rows to make up the 21-day or 28-day cycle, provides a satisfactory approach.

Since the blister packs may be carried around by the birth control user, it is necessary to protect the tablets in the blister pack from damage which ma occur over the cycle. This need has resulted in numerous arrangements for retaining blister packs. Many of the prior art packages for retaining birth control blister packs are relatively complex and expensive to manufacture in that they have latches and hinges. Moreover, they may from time to time become jammed. These devices are exemplified by the dial type of container disclosed in U.S. Pat. No. 4,165,709. The operation of these dial-type dispensers may not be readily apparent to all users and from time to time mistakes are made in dispensing the tablets due to the complexity of these dispensers. Other types of tablet containers using oval or circular arrangements are exemplified by the containers of U.S. Pat. Nos. 3,283,885 and 4,165,709.

As exemplified perhaps by U.S. Pat. Nos. 3,677,397 and 3,504,788 there are several tablet containers for birth control tablets which have flexible covers. These particular arrangements do not adequately protect the tablets in that pressure applied to the covers can damage the tablets or cause the tablets to be inadvertently dispensed through the trays upon which they are mounted. In order to avoid this, many commercial containers have domed covers.

U.S. Pat. Nos. 3,527,190; 3,584,598; 3,579,883 and 3,630,171 are illustrative of tablet containers which utilize hinged covers. Containers using hinged covers are relatively expensive in that they require both a hinge and a latch. These parts must be carefully molded and are subject to wear and breakage. Moreover, when these containers have compartments for dispensing tablets, the dispensed tablets tend to become jammed in the compartments. Accordingly, containers utilizing hinged covers have several drawbacks.

There are also numerous patents disclosing a tablet-containing tray disposed within a sleeve, however, none of these arrangements have been specifically adapted to the art of dispensing birth control tablets so as to cure the deficiencies of prior art birth control containers. For example, U.S. Pat. Nos. 3,033,355 and 3,397,770 each disclose partial covers, however they do not disclose just how one would adhere in an indicia strip or support a blister pack. Nor do they disclose a reliable coupling between the cover and tray or an arrangement for preventing the tray from sagging with respect to the cover. U.S. Pat. No. 1,988,134 discloses a tray which is slideable in a sleeve with a stop, however there is no disclosure of a stop which is configured in a easily manufactured arrangement which also adequately supports the tray with respect to the cover in which it is received. Trays which have complex and extensive surface contact with the sleeves or covers in which they are received can upon occasion rather easily become jammed since debris can collect in convoluted surfaces.

In view of the aforementioned considerations, there is a need for containers for tablets such as blister packaged birth control tablets, which containers do not have drawbacks such as the drawbacks of the afore-discussed patents. Moreover, there is a need for such container wherein the container has the general appearance of a cosmetic item.

SUMMARY OF THE INVENTION

It is an object of the instant invention to provide new and improved containers for storing and dispensing a supply of tablets, such as birth control tablets, which must be dispensed during a preselected cycle.

Upon further study of the specification and appended claims, further objects and advantages of this invention will become apparent to those skilled in the art.

In view of the aforementioned object and other objects, the instant invention contemplates a tablet container for retaining a blister pack having an array of tablets thereon arranged in a predetermined pattern, wherein the blister pack is mounted on a tray member which is slideably received within a cover member. The tray member has a deck having an array of holes therethrough in a pattern which corresponds to the pattern of the array of tablets in the blister pack. The length of the deck portion of the tray is slightly less than the length of the cover so as to provide a portion of the tray which remains in the cover when all of the tablets are exposed, whereby the tray is stabilized and does not sag when fully extended. Locking means are provided for retaining the tray in the cover with all of the tablets exposed so that the cover does not become detached from the tray.

In accordance with a preferred embodiment of the invention, the invention is used to store and dispense birth control tablets in accordance with either a 21-day or 28-day cycle. The holes in the deck are therefore either arranged in seven columns with three rows each for a 21-day cycle or seven columns with four rows each for a 28-day cycle. Adjacent the deck there is an angled surface for the display of indicia which are aligned with the columns wherein each column represents one day of the week.

In accordance with one embodiment of the invention, the cover does not have a bottom. Consequently, the cost of the cover is minimized, the container is easy to open and the blister pack is visible.

BRIEF DESCRIPTION OF THE DRAWINGS

Various other objects, features and attendant advantages of the present invention will be more fully appreciated as the same becomes better understood when considered in connection with the accompanying drawings, in which like reference characters designate the same or similar parts throughout the several views, and wherein.

DESCRIPTION OF THE PREPARATION EMBODIMENT

Figure 1:
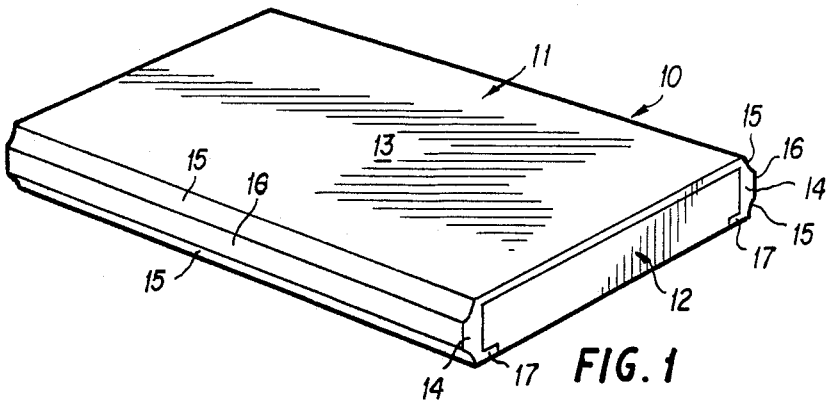
FIG. 1 is a top perspective view of the tablet container in accordance with the instant invention showing the tablet container closed.

Referring now to FIG. 1, there is shown a tablet container, designated generally by the numeral 10 which includes a cover member, designated generally by the numeral 11, and a tray member, designated generally by the numeral 12. The tray member 12 fits completely within the cover member 11 when the tablet container 10 is closed. The cover member 11 is rectangular in configuration and includes a top portion 13 and a pair of side walls 14. The side walls 14 each have a pair of concave flutes 15 therein which converge to a flat surface 16. The flutes 15 and flat 16 provide the tablet container 10 with the appearance of a compact in which one may carry cosmetics, for example, rather than tablets, such as birth control tablets. Extending inwardly from the side walls 14 are a pair of opposed lips 17 which engage the bottom of the tray member 12 and cooperate with the top portion 13 of the cover member to form a track for slidably retaining the tray member within the cover member 11.

Figure 2:
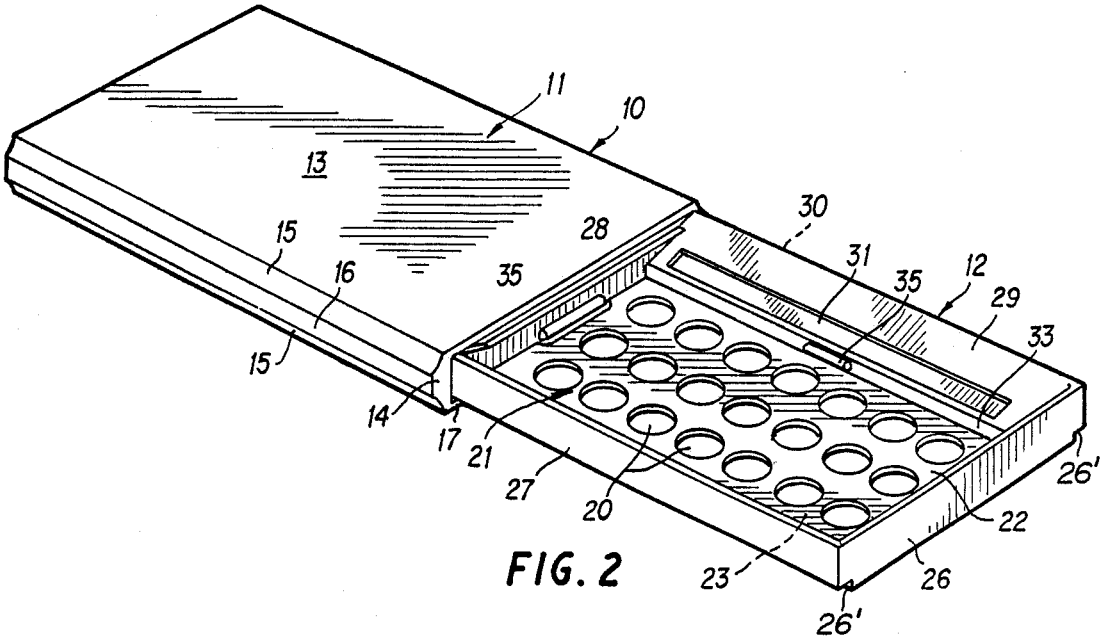
FIG. 2 is a top perspective view of the tablet container of the instant invention showing the tablet container in an open condition.

Referring now mainly to FIG. 2, wherein the tablet case is shown in its open condition, it is seen that the tray 12 is slideable from within the cover 11 to an open position which displays and renders accessible a complete array of holes 20 formed in a deck, designated generally by the numeral 21. The deck 21 has an upper surface 22 and a lower surface 23 with the holes 20 going completely through the deck 21 from the upper surface to the lower surface. The array of holes 20 is configured in columns of seven holes and rows of three holes to provide for a twenty-one day cycle. The deck 21 is surrounded on three sides by walls including a completely flat, planar end wall 26, a side wall 27 and a rear wall 28. The flat end wall 26 has a pair of outwardly opening notches 26' which receive the lips 17 therein so that the end of the container 10 is flat with the end wall being flush with the end of the tray 13. On the fourth side side, there is positioned a land 29 which slopes from a side wall 30 toward the deck 21. The land 29 has a rectangular, elongated indentation 31 therein which receives a "day strip" (see indicia strip 32 in FIG. 7) which aligns with the columns in the array of holes 20. The end walls 26 and 28 and a wall 33 depending from the land 29 each have lugs 35 thereon which are spaced from the top surface 22 of the land so as to retain a blister pack 37 (see FIGS. 7 and 8).

Figure 3:
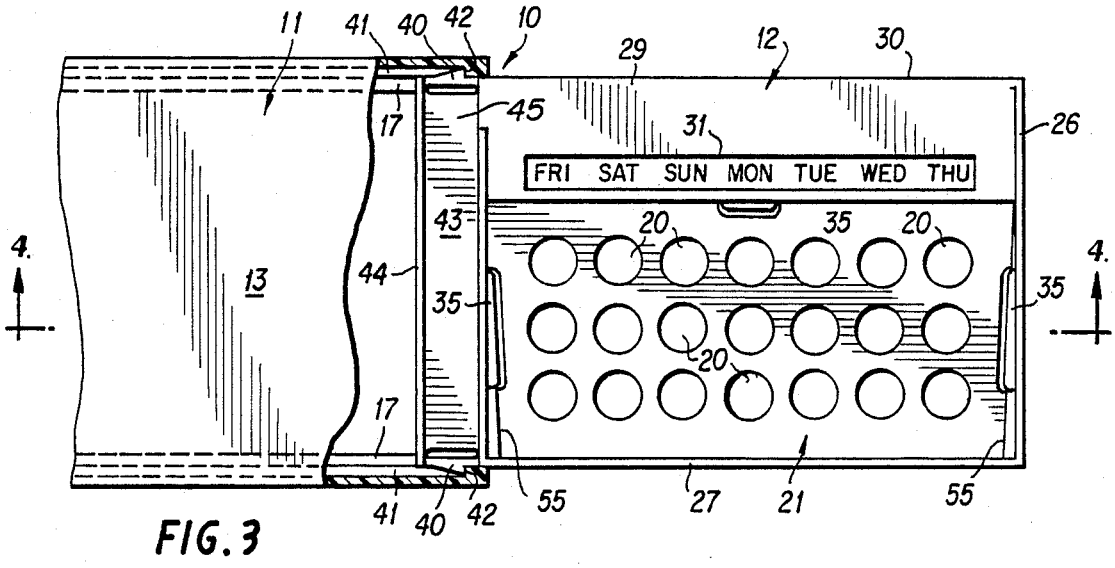
FIG. 3 is a top planar view, partially in section of the tablet container showing how the end portion of a tray member is locked within a cover member.
Figure 4:
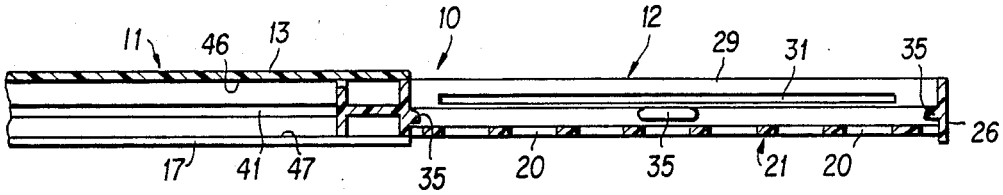
FIG. 4 is a side elevation taken along lines 4—4 of FIG. 3.
Figure 5:
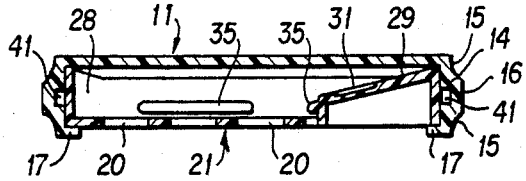
FIG. 5 is an end cross-section of the container showing the container when the container is closed.

Referring now to FIG. 3, it is seen that the tray member 12 of the container 10 is held in the cover member 11 by a pair of resilient detents 40 which project laterally of the tray member 12 and are received in a pair of opposed slots 41 when the tray member 12 is pulled to the completely open position, the detents 40 engage stops 42 located at the ends of the slots 41 thus preventing the tray member 12 from sliding completely out of the cover member 11. The tray member 12 has an open frame 43 which projects rearwardly from the rear wall 28 adjacent the deck 21. Frame 43 is rigidly attached to the tray member 12 and remains within the cover member 11 when the tray member 12 is completely projected. Consequently, the tray member 12 is stable with respect to the cover member 11 when projected and remains aligned with the space in the cover member defined by the inside surfaces of the top 13 and side walls 14 of the cover member. The frame 43 has a rear flange 44 and a plate 45 extending parallel to the deck 21, the plate being coplanar with the detents 40. The rear flange or rear wall 44 extends between the lower surface 46 of the top portion 13 of the cover member 11 and the inner surface 47 of the opposed lips 17 which project inwardly from the side walls 14 of the cover member. Since the rear wall 28 adjacent the deck 21 also projects from the lower surface 46 of the top wall 13 to the top surfaces 47 of the lip 17 the entire tray member 12 is supported relative to the cover member 11.

Figure 6:
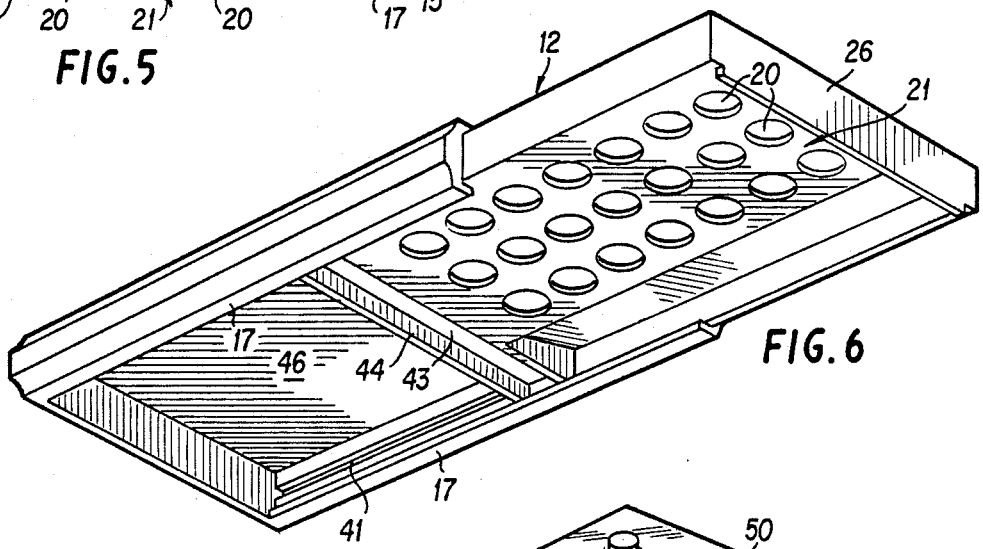
FIG. 6 is a bottom view, in perspective, of the tablet container with the container partially open.

As is seen in FIG. 6, the cover member 11 has a top 13, but is open on the bottom. Consequently, one can tell at a glance if a blister pack 37 is installed within the tablet case 10 by simply looking at the bottom of the tablet case.

Figure 7:
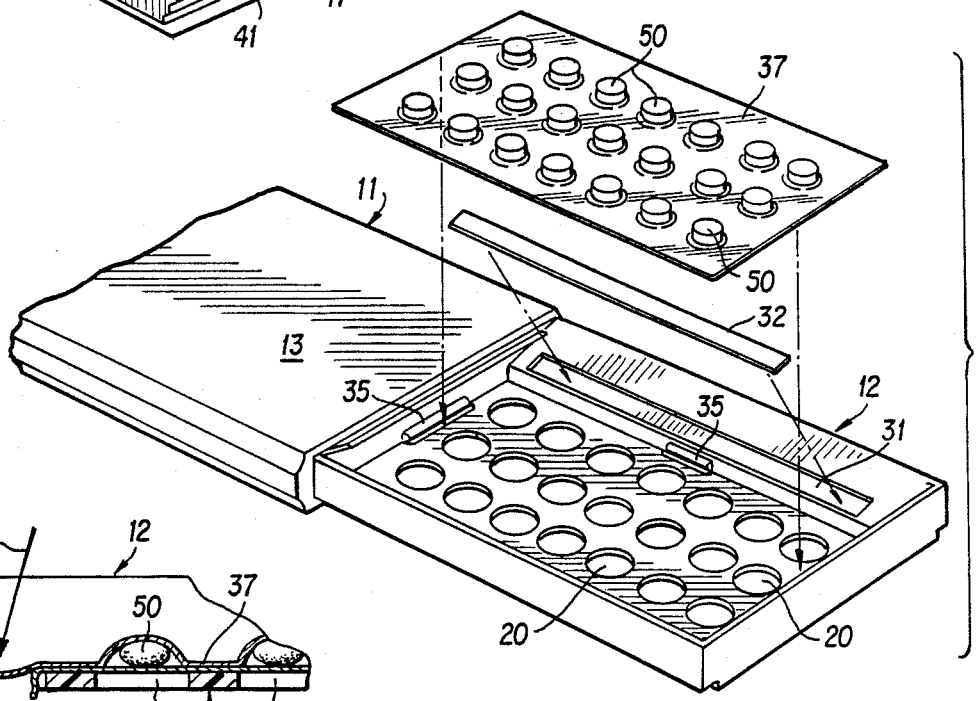
FIG. 7 is a top view, in perspective, of the tablet container showing how a blister pack containing twenty-one birth control tablets is mounted within the tray of the tablet container and how "day strip" is mounted adjacent the blister pack.
Figure 8:
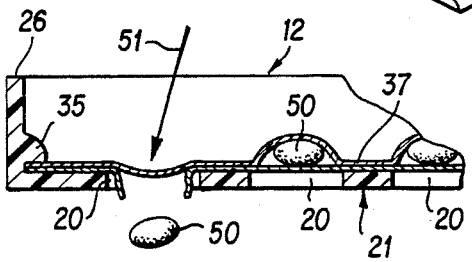
FIG. 8 is an elevation view of a portion of the tray with the blister pack mounted thereon showing how the tablets are dispensed from the tray.

Referring now to FIGS. 7 and 8, the blister pack 37 of the embodiments shown in FIGS. 2, 3, 6 and 7 has 21 tablets mounted therein for use in a 21-day birth control cycle. Aligned with the tablets on the elongated indentation 31 in the land 29 is an indicia strip 32 which has the days of the week sequentially printed thereon. A number of indicia strips 32 are provided with each container 10, each strip starting with a different day and continuing with the days in sequence from that day. Strip 32 preferably has an adhesive backing so as to be readily secured within the indentation 31. As is seen in FIG. 8, for each day of the cycle a tablet 50 is dispensed from the tablet container 10 by pressing thereon with ones finger in the direction of the arrow 51. This causes the lower foil layer 52 of the blister pack 37 to rupture allowing the tablet 50 to pass through the aligned hole 20 into the users hand. The user knows that a tablet has been dispensed for a particular day simply because if no tablet 50 is present in the array for a particular day it can be assumed that the tablet 50 has been taken. Of course, if there is a tablet in the array for a particular day, the user knows to take the tablet.

Figure 9:
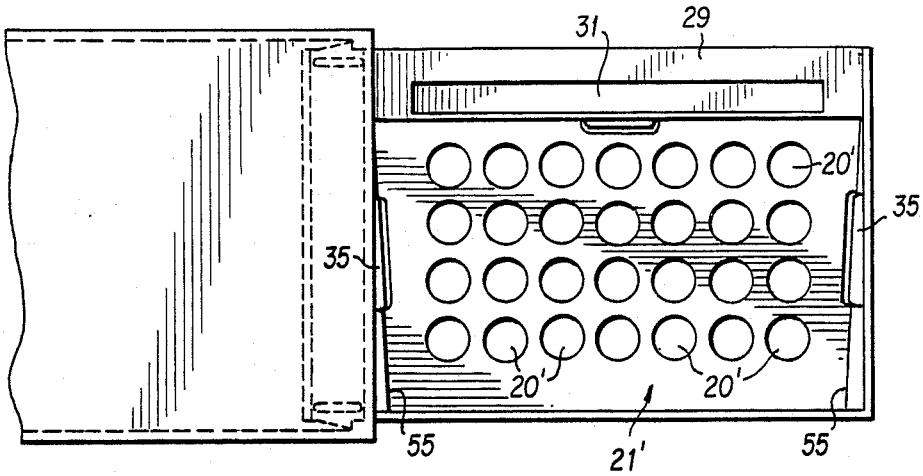
FIG. 9 is a top view of another embodiment of the invention showing the tray with holes arranged for a 28-day birth control cycle.
Figure 10:
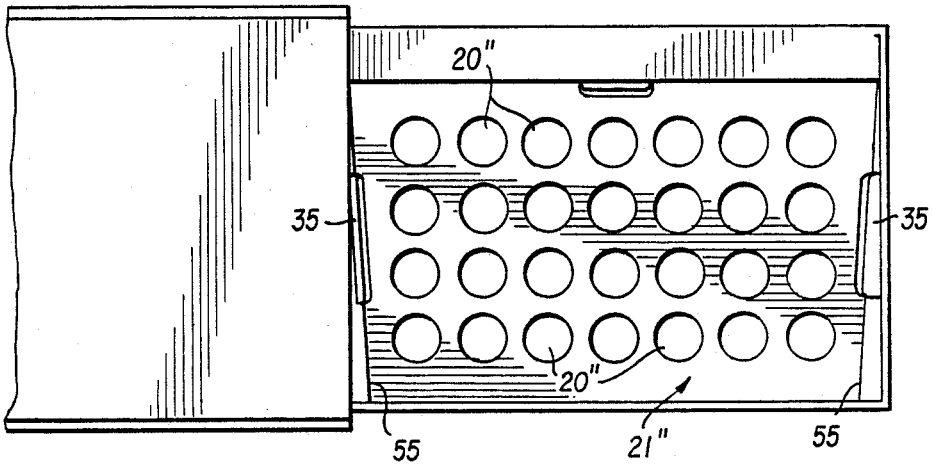
FIG. 10 is the top view of still another embodiment of the invention showing holes arranged for a 28-day cycle wherein holes are relatively large to accommodate larger tablet sizes than the tablets used with the embodiment of FIG. 9.

As seen in FIGS. 3, 9 and 10 angled walls 55 are positioned beneath the lugs 35 and adjacent to the walls 26 and 28 so as to render the deck 21 trapazoidal in shape. The blister pack 37 is also trapazoidal in the shape so as to conform with the shape created by the angled walls 55. Accordingly, the blister pack 37 can be properly oriented in the tray 12 with relative ease.

The array of holes 20 shown in FIGS. 2, 3, 6 and 7 is for a twenty-one day cycle with an "any-day" start, wherein the user picks her starting day, selects a label 32 with that particular starting day and places it in place. The tablets 50 used with this cycle typically contain two constant ingredients and are relatively large, requiring relatively large holes 20. The complete cycle actually lasts twenty-eight days with twenty-on days on and seven days off.

Referring now to FIG. 9, there is shown an embodiment of the invention wherein the holes 20' are arranged in an array for a twenty-eight-day cycle wherein there are seven columns (one column for each day of the week) and four rows. With this arrangement the tablet 50 for each day contains a different amount of active ingredients and one level of placebo. The arrangement of FIG. 9 is for an "any day" start and like the arrangement of FIGS. 2, 3, 6 and 7 is accompanied with a plurality of labels of seven configurations wherein each configuration starts with a different day of the week.

Referring now to FIG. 10, there are also twenty-eight holes 20" in the tray 12". However, there is no land 29 or elongated indentation 31 for accomodating an indicia strip 32. This is because the container 10" is configured to retain a blister pack (not shown) which is designed for a "Sunday start" only, wherein the blister pack has the days of the cycle printed directly thereon. With this arrangement there are twenty-one tablets 50 with active ingredients and seven tablets containing a placebo.

The foregoing embodiments of the tablet case 10 disclose a tablet case which contains all the tablets necessary for either a twenty-one-day or twenty-eight-day birth control cycle. The tablet case 10 is unobtrusive and attractive in appearance and resembles a compact rather than a case for birth control tablets. The arrangement of dispensing holes 20 in combination with day indicia provides a convenient and reliable structure for accurately following a twenty-one-or twenty-eight-day prescription cycle.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A container specifically for containing tablets, such as birth control tablets, retained in an array in a blister pack, the container comprising:

a tray made of plastic for supporting the blister pack on a deck surrounded by parallel front and back walls and by parallel side walls, the deck having an array of holes therethrough corresponding to the array of tablets retained in the blister pack; the deck having first and second surfaces, the first surface being in abutment with the blister pack and the second surface being exposed, whereby tablets may be dispensed from the blister pack by pressing against the tablets to push the tablets from the first surface, through the holes and out past the second surface; a land disposed on the tray adjacent to the deck, the land having fixed indicia for displaying the days of the week aligned with the holes through the deck; the tray member having a prescribed length between inner and outer ends, the inner end having a box frame just inboard thereof and the outer end being a completely flat end plate having a pair of oppositely opening notches;

a cover made of plastic and slidably receiving the tray member for covering the contents of the container, the cover member being bottomless; the cover member having a top panel for covering the first surface of the deck when the tray member is slidably received within the cover member and the cover member being open adjacent the second surface of the deck member; the cover member having a pair of opposed side walls with lips extending toward one another and spaced from the top panel for retaining the tray member therebetween and a back wall for stopping sliding movement of the tray member; the side walls of the cover member each having an outer surface defined by a pair of convex flutes spaced by a projection planar portion; the cover member having a length slightly greater than the tray member, wherein when the tray member is pushed completely into the cover member the end plate of the tray member is within the cover member and flush with respect to end of cover member, with the pair of opposed lips being received within the oppositely opening notches;

stop means for preventing the tray member from disengaging completely from the cover member; the stop means including a pair of opposed, longitudinally extending grooves in the pair of opposed side walls of the cover member and a pair of resilient lateral detents integral with the tray member and positioned outboard of the box frame, the detents being received in the opposed grooves, the opposed grooves having stops adjacent the open end of the cover member, which stops are engaged by the detents when the tray member is in the fully open position to limit projection of the tray member from the cover member, wherein a portion of the tray member remains within the cover member when the tray is fully projected;

a plurality of lug members positioned in spaced relation with respect to the first surface of the deck for retaining the blister pack in abutment with the first surface; and a pair of opposed guide walls positioned adjacent the first surface of the deck and extending at an oblique angle with respect to the back walls of the tray member for orienting the blister pack correctly with respect to the array holes through the deck.

2. The tablet container of claim 1, wherein the array of tablets in the blister pack and the array of holes in the deck are arranged in columns of seven and rows of four wherein each column corresponds to a day of the week providing twenty eight-day for utilization of the tablets of each blister rack.

3. The tablet container of claim 1, wherein the tablets in the blister pack and the array of holes in the deck are arranged in columns of seven and rows of three wherein the columns each correspond to a day of the week providing a twenty-one-day cycle for utilization of the tablets of each blister pack.

4. The container of claim 1 wherein the box frame on the tray comprises a plate extending parallel with the deck but displaced in a direction normal thereto, the plate being coplanar with the lateral resilient detents, the plate abutting an inner end wall that extends normal to the plate.

* * * * *

UNITED STATES PATENT AND TRADEMARK OFFICE

CERTIFICATE OF CORRECTION

PATENT NO. : 4,817,819

DATED : April 4, 1989

INVENTOR(S) : Thomas K. Kelly

It is certified that error appears in the above-identified patent and that said Letters Patent is hereby corrected as shown below:

Column 1, line 25 "which ma occur" should read ----which may occur----.

Column 5, line 14 "with twenty-on days" should read ----with twenty-one days----.

Column 5, line 56 "a tray made of plastic" should read ----a tray member made of plastic----.

Signed and Sealed this

Seventh Day of August, 1990

*Attest:*

HARRY F. MANBECK, JR.

*Attesting Officer*

*Commissioner of Patents and Trademarks*